US005880555A

United States Patent [19]

Park

[11] Patent Number: 5,880,555

[45] Date of Patent: Mar. 9, 1999

[54] COLOR CATHODE RAY TUBE AND A MAGNETIC SHIELDING BODY THEREFOR

[75] Inventor: Jae-Kyu Park, Seoul, Rep. of Korea

[73] Assignee: LG Electronics, Inc., Seoul, Rep. of Korea

[21] Appl. No.: 677,782

[22] Filed: Jul. 10, 1996

[30] Foreign Application Priority Data

Jul. 28, 1995 [KR] Rep. of Korea ..... 1995-22930

[51] Int. Cl.[6] ..... H01J 29/06

[52] U.S. Cl. ..... 313/402; 313/407; 313/479

[58] Field of Search ..... 313/402, 479, 313/326, 352, 239, 407; 174/35 MS

[56] References Cited

U.S. PATENT DOCUMENTS

| | | | |
|---|---|---|---|
| 4,019,085 | 4/1977 | Sakata | 313/479 X |
| 4,580,076 | 4/1986 | Simoma et al. | 313/402 |
| 5,519,283 | 5/1996 | Opresko et al. | 313/479 |

FOREIGN PATENT DOCUMENTS 63-67307 12/1988 Japan .

*Primary Examiner*—Ashok Patel

[57] ABSTRACT

A color cathode ray tube for permitting electron beams emitted from an electron gun to pass through apertures of a shadow mask and collide onto phosphors coated on the inner surface of a panel to thereby reproduce image information includes a magnetic shielding body which, for decreasing an influence of a terrestrial magnetic field, is formed of a rectangularly-shaped magnetic material and has one ends supported by the shadow mask to be symmetrical along the horizontal and vertical axes of the tube, and a plurality of notches formed into the magnetic shielding body are classified by the horizontal and vertical axes to be distributed asymmetrical with respect to the horizontal or vertical axes within four quadrants partitioned by the horizontal and vertical axes. Thus, the quantity of the landing variation in a specific portion having the greater quantity of the landing variation is reduced during the change of an outer magnetic field or the direction shift of the cathode ray tube.

7 Claims, 5 Drawing Sheets

COLOR CATHODE RAY TUBE AND A MAGNETIC SHIELDING BODY THEREFOR

BACKGROUND OF THE INVENTION

1. Field of the Invention

The present invention relates to a color Braun tube, and more particularly to a color cathode ray tube for decreasing the landing variation caused by the change of an external magnetic field.

2. Description of Related Art

Generally, a color cathode ray tube as shown in FIG. 1 has a panel 1 coated with R,G,B phosphors on the inner surface thereof. Panel 1 is closely mated with a funnel 2, having a neck 3 into which is sealed an electron gun 4 therein for emitting multiple electron beams 5. Electron beams 5 emitted from electron gun 4 pass through apertures of a shadow mask 7 connected to a frame 8 accurately corresponding to phosphors. Electron beams 5 land on respective phosphors 6, thereby illuminating phosphors 6. Here, the landing of electron beam is affected by external magnetic fields such as ambient terrestrial magnetic fields. This degrades color purity of a reproduced image. For this reason, a magnetic shielding plate 9 has been conventionally employed, consisting of a metal sheet having one ends connected to frame 8 and the other end extending toward the apex of funnel 2.

Japanese Patent Laid-open Publication No. sho 63-67307, as shown in FIGS. 2A–2C, discloses a magnetic shielding plate 9 that includes a plurality of openings 10 which are symmetrical with respect to the horizontal axis x or vertical axis y of the tube (see FIGS. 2B and 2C).

Conventional magnetic shielding plate 9 is formed with openings 10 which are symmetrical with respect to the horizontal axis or vertical axis of the tube for converting the vertical component magnetic field of a barrel-type magnetic field A formed by the vertical magnetic field as shown in FIG. 3 into the horizontal component magnetic field to serve as a magnetic resistance B. Therefore, the change into the vertical magnetic field is decreased by the horizontal magnetic field as shown in FIG. 4. A barrel-type magnetic field D decreased at this time reduces errant electron beam landing caused by a change in an external magnetic field or direction shift of the cathode ray tube.

However, the quantity and direction of the electron beam mislanding, occurring at panel 1 of the cathode ray tube when an external magnetic field or the direction of the cathode ray tube changes, are not symmetrical with respect to the horizontal axis or vertical axis of the tube.

In more detail, when the horizontal magnetic field is applied from left to right of the cathode ray tube (in the positive direction) as shown in FIG. 3, a barrel-type magnetic field is formed within the cathode ray tube. Also, when the horizontal magnetic field is applied from the right to left (in the negative direction), a barrel-type magnetic field is formed in an opposite direction to the barrel-type magnetic field formed under the horizontal magnetic field along the positive direction. FIG. 5 illustrates the front of the cathode ray tube, especially the corner portions thereof, by separating a difference of the magnetic field formed within the cathode ray tube into the horizontal and vertical components in accordance with the magnetic fields of the positive and negative directions. Since the vertical magnetic field component affects the mislanding in the cathode ray tube for the use in the television, the horizontal magnetic field component is not considered.

Because of problems like structural asymmetry resulting from the manufacturing error of the cathode ray tube, and asymmetry of the substance characteristic and the like in the four quadrants of the front of the cathode ray tube defined by the horizontal axis and vertical axis of the cathode ray tube, the amount of variation in the vertical magnetic field is not the same at any time where an external magnetic field changes or the direction of the cathode ray tube shifts.

Portions having greater magnetic field difference such as at f or s of FIG. 5 occur to therefore differ the quantity of the landing variation by the changed amount of the vertical magnetic field in respective quadrants. The portions having the greater amount of the changed vertical magnetic field such as at f or g have the increased quantity of the landing variation, compares to h or i of FIG. 6. In more detail, the difference of the vertical magnetic field occurring within the cathode ray tube due to the positive and negative horizontal magnetic fields is symmetrical with respect to the horizontal axis or vertical axis of the cathode ray tube. Then, the asymmetrical difference of the vertical magnetic field forces the quantity of the landing variation to be asymmetrical at respective corners of the cathode ray tube when the external magnetic field or the direction of the cathode ray tube changes.

FIG. 7 represents the number of times that a landing variation occurs in respective quadrants when the horizontal magnetic field is changed in a 24-inch cathode ray tube. Here, the number of the landing variations in of the first quadrant is the greatest. Thus, color purity of the color cathode ray tube is degraded from the portion having the greatest number of landing variations when an external magnetic field or the direction of the cathode ray tube, thereby inducing the question at issue in the quality of the cathode ray tube changes.

SUMMARY OF THE INVENTION

It is an object of the present invention to provide a color cathode ray tube capable of decreasing the occurrence of landing variations when an external magnetic field or the direction of the cathode ray tube is changed.

To achieve the above object of the present invention, a color cathode ray tube is provided that permits electron beams emitted from an electron gun to pass through apertures of a shadow mask. The electron beams then collide onto phosphors coated on the inner surface of a panel to reproduce image information. The color cathode ray tube includes a magnetic shielding body, for decreasing an influence of a terrestrial magnetic field, and is formed of a rectangularly-shaped magnetic material and has one end supported by the shadow mask so as to be symmetrical along the horizontal and vertical axes of the tube, and a plurality of openings formed into the magnetic shielding body are classified by the horizontal and vertical axes to be distributed asymmetrical with respect to the horizontal or vertical axes within four quadrants partitioned by the horizontal and vertical axes.

BRIEF DESCRIPTION OF THE DRAWINGS

The above objects and other advantages of the present invention will become more apparent by describing in detail preferred embodiments thereof with reference to the attached drawings in which:

FIG. 10 is a view showing the magnetic field and the landing variation resulting therefrom, wherein

DETAILED DESCRIPTION OF THE PREFERRED EMBODIMENT

A preferred embodiment of a color cathode ray tube according to the present invention will be described with reference to the accompanying drawings.

Figure 1:
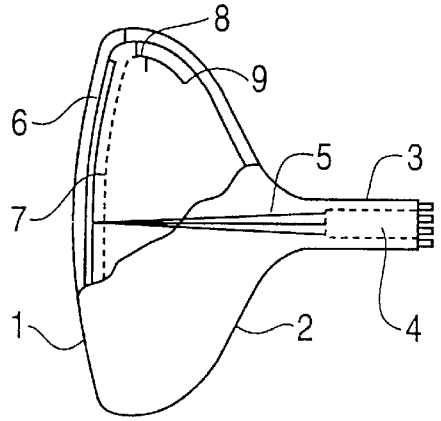
FIG. 1 (PRIOR ART)
FIG. 1 is a schematic view showing a construction view of a conventional color cathode ray tube.
Figure 2A:
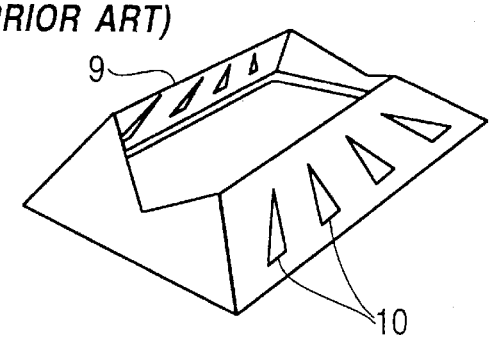
FIG. 2(A) (PRIOR ART)
FIGS. 2A, 2B and 2C are a perspective view, a plan view, and a side view, respectively, showing a conventional magnetic shielding plate, respectively.
Figure 2B:
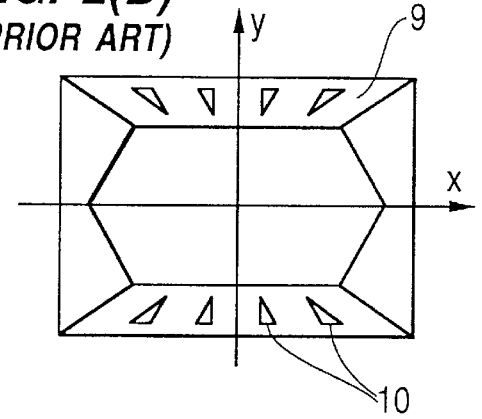
FIG. 2(B) (PRIOR ART)
Figure 2C:
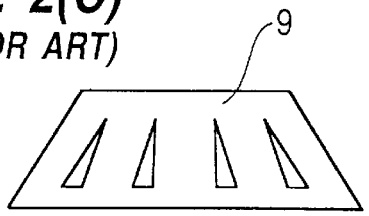
FIG. 2(C) (PRIOR ART)
Figure 3:
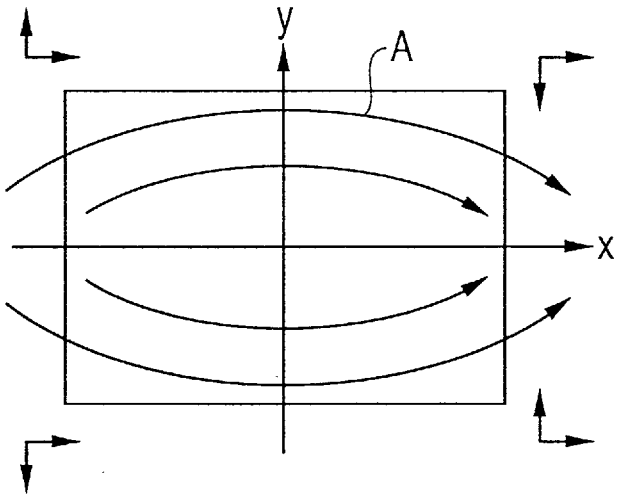
FIG. 3 (PRIOR ART)
FIG. 3 is a view showing the state of the barrel-type magnetic field conventionally formed within the cathode ray tube by the horizontal magnetic field.
Figure 4:
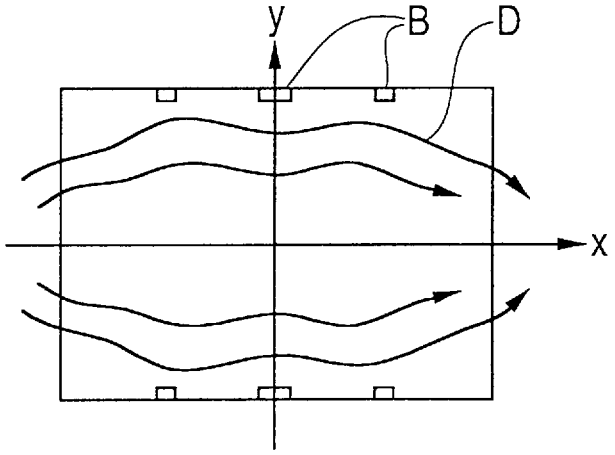
FIG. 4 (PRIOR ART)
FIG. 4 is a view showing the state of the barrel-type magnetic field decreased by the change of the conventional horizontal magnetic field.
Figure 5:
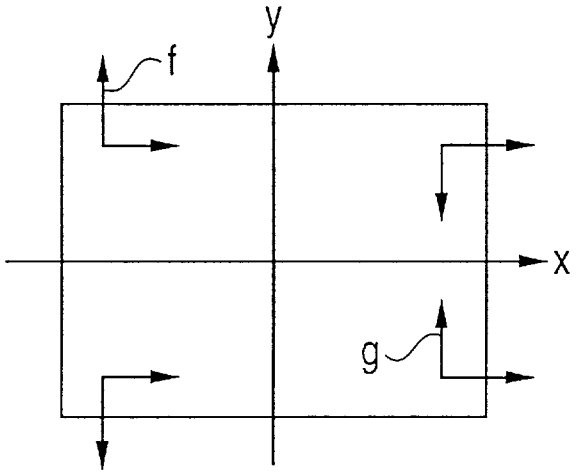
FIG. 5 (PRIOR ART)
FIG. 5 is a view showing the state of the magnetic field formed within the cathode ray tube due to the change of the conventional horizontal magnetic field.
Figure 6:
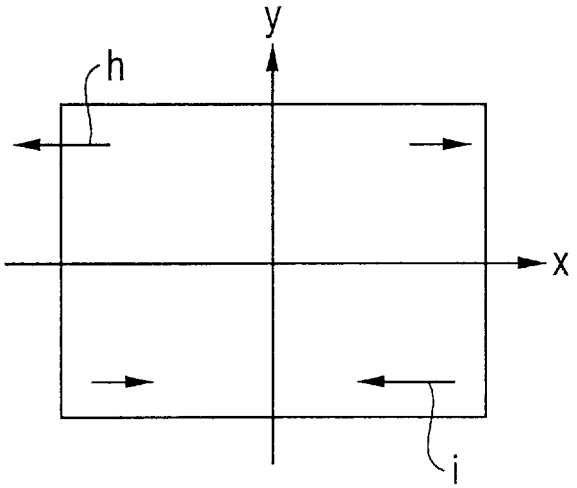
FIG. 6 (PRIOR ART)
FIG. 6 is a view showing the state of the landing variation caused by the vertical magnetic field formed due to the change of the conventional horizontal magnetic field.
Figure 7:
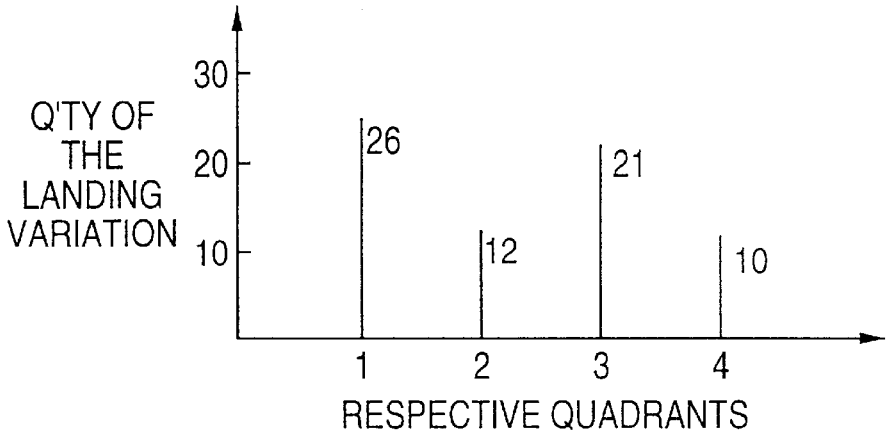
FIG. 7 (PRIOR ART)
FIG. 7 represents the distribution of the landing variations at respective quadrants when the conventional horizontal magnetic field is changed.
Figure 8A:
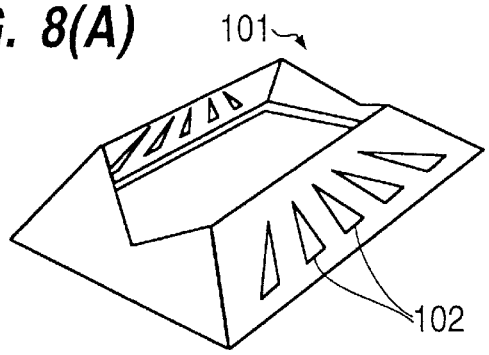
FIGS. 8A, 8B and 8C are a perspective view, a plan view and a side view, respectively, showing a magnetic shielding body according to the present invention.
Figure 8B:
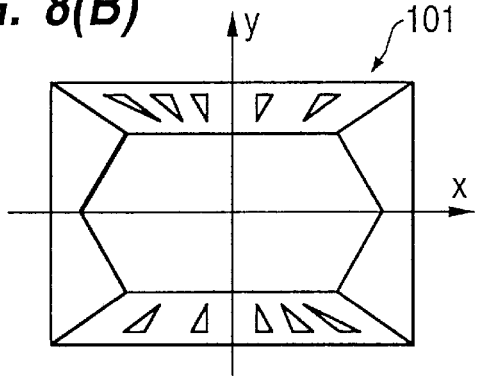
Figure 8C:
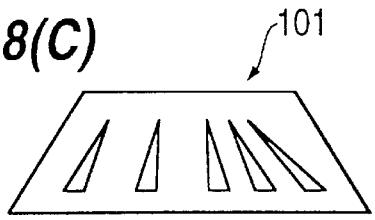

FIGS. 8A–8C illustrate a magnetic shielding body according to the present invention, in which magnetic shielding body 101 is formed with a plurality of openings 102 distributed asymmetrically with respect to the horizontal axis x and the vertical axis y of the tube. In other words, the portion of magnetic shielding body 101 corresponding to the quadrant having the greater occurrences of landing variation during changing an outer magnetic field or the direction shift of cathode ray tube is provided with openings 102 which are either larger in size or greater in number than those formed in other portions of magnetic shielding body 101. Here, the remaining structure of the color cathode ray tube according to the present invention is identical to that of the conventional one, so detailed description thereof will be omitted.

That is, when the plurality of openings 102 are formed in magnetic shielding body 101, a leakage magnetic field appears around notches 102 according to the present invention. Then, the leakage magnetic field is to be strong and extend a wide area as the notches are greater in size. The present invention utilizes such an action to make the magnetic field uniform where the electron beams passes through.

By providing openings 102 in magnetic shielding body 101 that one asymmetrical to the vertical axis y and horizontal axis x, the amount of the vertical magnetic field component in a barrel magnetic field at a specific area is decreased when the external magnetic field or the direction of the cathode ray tube is changed. The occurrence of the landing variation at the specific portion.

Figure 9:
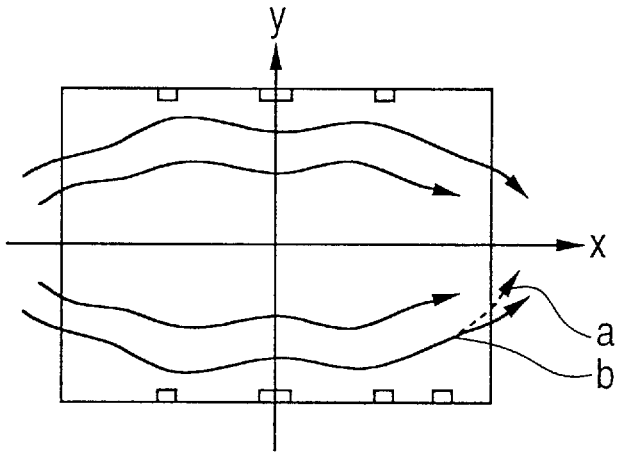
FIG. 9 is a view showing the state of the barrel-type magnetic field according to the present invention.

In FIG. 9, reference symbol a plots the conventional magnetic distribution, whereas b plots that according to the present invention.

Figure 10A:
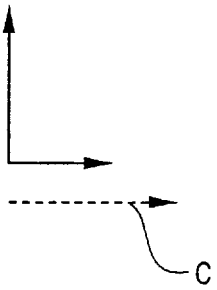
FIG. 10(A) (PRIOR ART)
FIG. 10A shows a magnetic distribution view of the conventional technique.
Figure 10B:
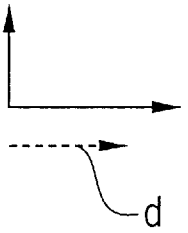
FIG. 10B shows a magnetic distribution view according to the present invention.

Also, FIG. 10A shows the magnetic field by the conventional technique and landing variation x resulting therefrom, and FIG. 10B is that according to the present invention and landing variation y resulting therefrom.

As a result, the vertical magnetic field component is decreased and horizontal magnetic field component is increased by the magnetic shielding body, thereby reducing the occurrence of the landing variations at the specific portion in the color cathode ray tube.

In the color cathode ray tube according to the present invention as described above, the openings 102 of the magnetic shielding body 101 are provided asymmetrically with respect to the horizontal axis and vertical axis of the magnetic shielding body of the tube. By doing so, the occurrence of landing variations at the specific portion conventionally having many landing variations is decreased when an external the outer magnetic field or a direction of the cathode ray tube is changed, so that the magnetic-field shielding effect by the cathode ray tube is enhanced to increase marginal range during the direction shift.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A color cathode ray tube comprising:

a front panel coated with a phosphor, said front panel including four quadrants defined by a pair of orthogonal axes lying in the plane of said front panel;

a funnel having first and second ends, said front panel being mated with said funnel at said first end, said second end being narrowed so as to define a neck portion;

an electron gun assembly disposed in said neck portion and being constructed and arranged to project an electron beam toward said front panel;

a shadow mask arranged relative to said front screen and having a plurality of openings formed therethrough, said plurality of openings permitting said electron beam to pass therethrough so as to land on said front panel;

a magnetic shielding body mounted within said funnel about a periphery of said funnel adjacent said first end thereof, said magnetic shielding body being provided with a plurality of openings formed therethrough, wherein portions of said magnetic shielding body associated with a pair of adjacent said quadrants located on opposite sides of one axis of said pair of orthogonal axes, respectively, are asymmetric with respect to a number of openings provided in each of said respective portions.

2. A color cathode ray tube as claimed in claim 1, wherein said first end of said funnel is rectangular, said magnetic shielding body being correspondingly rectangular.

3. A color cathode ray tube as claimed in claim 1, wherein a portion of said magnetic shielding body associated with a quadrant of said front panel where a comparatively high frequency of electron beam landing variations occurs, compared to other said quadrants of said front panel, is provided with a higher number of said openings, relative to other said portions of said magnetic shielding body associated with said other quadrants of said front panel, respectively.

4. A color cathode ray tube as claimed in claim 1, wherein said magnetic shielding body is made from a magnetic material.

5. A color cathode ray tube comprising:

a front panel coated with a phosphor, said front panel including four quadrants defined by a pair of orthogonal axes lying in the plane of said front panel;

a funnel having first and second ends, said front panel being mated with said funnel at said first end, said second end being narrowed so as to define a neck portion;

an electron gun assembly disposed in said neck portion and being constructed and arranged to project an electron beam toward said front panel;

a shadow mask arranged relative to said front screen and having a plurality of openings formed therethrough, said plurality of openings permitting said electron beam to pass therethrough so as to land on said front panel;

a magnetic shielding body mounted within said funnel about a periphery of said funnel adjacent said first end thereof, said magnetic shielding body being provided with a plurality of openings formed therethrough, wherein portions of said magnetic shielding body associated with a pair of adjacent said quadrants located on opposite sides of one axis of said pair of orthogonal axes, respectively, are asymmetric with respect to a size of said openings provided in each of said respective portions, wherein a portion of said magnetic shielding body associated with a quadrant of said front panel where a comparatively high frequency of electron beam landing variations occurs, compared to said other quadrants of said front panel, is provided with larger said openings, relative to said other portions of said magnetic shielding body associated with said other quadrants of said front panel, respectively.

6. A color cathode ray tube as claimed in claim 5, wherein said first end of said funnel is rectangular, said magnetic shielding body being correspondingly rectangular.

7. A color cathode ray tube as claimed in claim 5, wherein said magnetic shielding body is made from a magnetic material.

* * * * *